US007972146B2

(12) United States Patent
Busse

(10) Patent No.: US 7,972,146 B2
(45) Date of Patent: Jul. 5, 2011

(54) PLUG-IN CONNECTOR FOR CIRCUIT BOARDS

(75) Inventor: Ralf-Dieter Busse, Hoppegarten (DE)

(73) Assignee: ADC GmbH, Berlin (DE)

( * ) Notice: Subject to any disclaimer, the term of this patent is extended or adjusted under 35 U.S.C. 154(b) by 0 days.

(21) Appl. No.: 12/519,648

(22) PCT Filed: Nov. 15, 2007

(86) PCT No.: PCT/EP2007/009867

§ 371 (c)(1),
(2), (4) Date: Dec. 21, 2009

(87) PCT Pub. No.: WO2008/074379

PCT Pub. Date: Jun. 26, 2008

(65) Prior Publication Data

US 2010/0151709 A1 Jun. 17, 2010

(30) Foreign Application Priority Data

Dec. 18, 2006 (DE) ..... 10 2006 059 766

(51) Int. Cl.
*H01R 12/00* (2006.01)

(52) U.S. Cl. ..... 439/78

(58) Field of Classification Search ..... 439/78, 439/83, 79, 76.2, 607.39, 81–82, 857
See application file for complete search history.

(56) References Cited

U.S. PATENT DOCUMENTS

| | | | | |
|---|---|---|---|---|
| 3,631,381 | A | 12/1971 | Pittman | |
| 3,710,303 | A | 1/1973 | Gallager, Jr. | |
| 4,262,981 | A | 4/1981 | Goodman | |
| 4,915,637 | A * | 4/1990 | Ogawa et al. | 439/76.2 |
| 5,618,187 | A * | 4/1997 | Goto | 439/79 |
| 7,270,573 | B2 * | 9/2007 | Houtz | 439/607.39 |
| 7,476,110 | B2 * | 1/2009 | Lemke et al. | 439/83 |

FOREIGN PATENT DOCUMENTS

| | | |
|---|---|---|
| DE | 1 081 098 | 6/1958 |
| DE | 2 238 515 | 2/1974 |
| DE | 102 57 308 | 7/2004 |
| GB | 2 050 078 | 12/1980 |
| TW | M259351 | 3/2005 |
| TW | M260036 | 3/2005 |

OTHER PUBLICATIONS

English language translation of Office Action issued Jun. 3, 2010 in corresponding Taiwanese Application No. 096146860.

* cited by examiner

*Primary Examiner* — Jean F Duverne
(74) *Attorney, Agent, or Firm* — Merchant & Gould P.C.

(57) ABSTRACT

The invention relates to a plug-in connector (1) for circuit boards (40), comprising a number of contact elements (30). Each contact element (30) is fitted with two terminal ends, one of which is designed as a wire-connecting contact for connecting wires while the other terminal end is designed as a tuning fork contact (31) for contacting terminal areas on a circuit board (40). The plug-in connector (1) further comprises a plastic housing inside which the contact elements (30) are arranged. The wire-connecting contacts can be connected from outside and are designed as wire-wrap contacts (32) which are disposed in at least two rows. The wire-wrap contacts (32) of the different rows are offset relative to one another.

6 Claims, 1 Drawing Sheet

PLUG-IN CONNECTOR FOR CIRCUIT BOARDS

This application is a National Stage Application of PCT/EP2007/009867, filed 15 Nov. 2007, which claims benefit of Serial No. 10 2006 059 766.4, filed 18 Dec. 2006 in Germany and which applications are incorporated herein by reference. To the extent appropriate, a claim of priority is made to each of the above disclosed applications.

BACKGROUND OF THE INVENTION

The invention relates to a plug-in connector for printed circuit boards.

Such a generic plug-in connector is known, for example, from DE 102 57 308 B3. The plug-in connector for printed circuit boards comprises a number of contact elements, the contact elements each having two connection sides, one connection side being in the form of an insulation displacement contact for connecting wires, and the other connection side being in the form of a fork contact for making contact with connecting pads on a printed circuit board, and a plastic housing, into which the insulation displacement contacts of the contact elements can be inserted, the insulation displacement contact and the fork contact being arranged such that they are turned towards one another and at least one lower edge of the insulation displacement contact being supported on the plastic housing, with the result that the contact elements are held in the plastic housing such that they are secured against falling out in the event of connection forces occurring on the insulation displacement contacts, the plastic housing comprising at least one region in the form of a chamber, and the fork contacts being completely accommodated by the plastic housing in the longitudinal direction, ribs being arranged in the region in the form of a chamber on the inner sides, which ribs define guides for the fork contacts, the contact regions of the fork contacts protruding beyond the ribs, and the ribs being beveled in the front region. The packing density is in this case largely fixed by the spacing between the fork contacts, which is in the region of a few millimeters.

SUMMARY OF THE INVENTION

The invention is now based on the technical problem of providing a plug-in connector for printed circuit boards which has alternative wire connection contacts to insulation displacement contacts without needing to reduce the packing density or connection density of the fork contacts.

In this regard, the plug-in connector for printed circuit boards comprises a number of contact elements, the contact elements each having two connection sides, one connection side being in the form of a fork contact for making contact with connecting pads on a printed circuit board, and a plastic housing, in which the contact elements are arranged, it being possible for the wire connection contacts to be connected from the outside, the wire connection contacts being in the form of wire wrap contacts, which are arranged in at least two rows, the wire wrap contacts of the different rows being arranged such that they are offset with respect to one another. This means that the distance between the individual wire wrap contacts can be selected to be sufficiently large in relation to one another in order to connect the wire wrap contacts using a connection tool without any problems and without needing to enlarge the spacing between the fork contacts.

In one preferred embodiment, the contact elements have an identical shape, the wire wrap contact being aligned asymmetrically with respect to the fork contact, and the contact elements being arranged in the plug-in connector such that they are turned alternately through 180° about the longitudinal axis of the contact element. Owing to the use of identical parts for the contact elements, the production process can be simplified and savings can be made on costs. In principle, however, the use of different contact elements is also possible.

In this case, the contact element may have an integral design or else be produced by assembling the fork contact and the wire wrap contact, for example by means of laser or resistance welding or else by means of adhesive bonding using electrically conductive adhesive, or else in a form-fitting and force-fitting manner. The integral embodiment has the advantage of simple manufacture, whereas the assembly offers the advantage of producing the two contacts from different materials, which are then each optimized to the respective requirements. Furthermore, a fork contact can then be fitted with different wire wrap contacts.

In a further preferred embodiment, the contact elements are arranged in the plastic housing such that they are secured against falling out.

Further preferably, the fork contact has a stop edge, which is supported in the housing. As a result, the connection forces when connecting the wire wrap contacts can be absorbed.

In one further preferred embodiment, the plastic housing comprises at least one region in the form of a chamber, the fork contacts being completely accommodated by the plastic housing in the longitudinal direction. Further preferably, ribs are arranged in the region in the form of a chamber on the inner sides, which ribs define guides for the fork contacts, the contact regions of the fork contacts protruding beyond the ribs, and the ribs being beveled in the front region. In terms of the configuration and the advantages which can be achieved thereby, express reference is made here to DE 102 57 308 B3.

In a further preferred embodiment, the plastic housing has a two-part design, it being possible for the housing parts to be latched to one another, which simplifies the support for the contact elements in the housing.

BRIEF DESCRIPTION OF THE DRAWINGS

The invention will be explained in more detail below with reference to a preferred exemplary embodiment. In the figures.

DETAILED DESCRIPTION OF THE PREFERRED EMBODIMENT(S)

Figure 1:
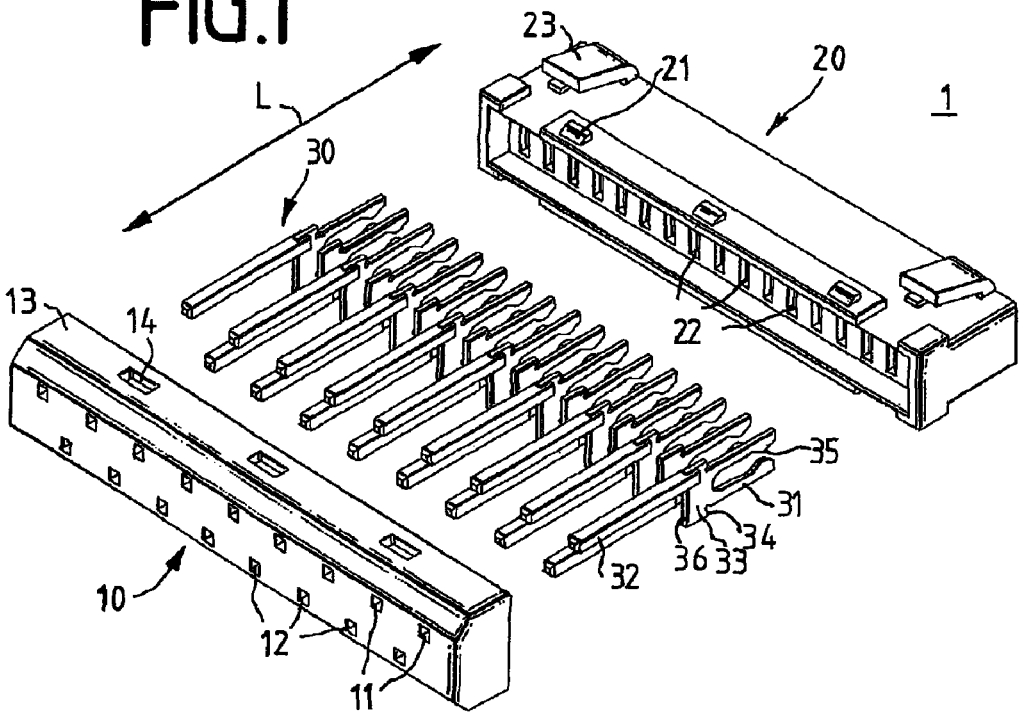
FIG. 1 shows an exploded illustration of a plug-in connector for printed circuit boards.

FIG. 1 illustrates a plug-in connector 1 for printed circuit boards 40. The plug-in connector 1 comprises a first housing 10, a second housing part 20 and a large number of contact elements 30, seventeen in the example illustrated. The contact element 30 has in each case two connection sides, one connection side being in the form of a fork contact 31, and the other connection side being in the form of a wire wrap contact 32. In the lower region, the fork contact 31 has a limb 33, which protrudes on one side and forms a stop edge 34. The wire wrap contact 32 is arranged on the side opposite the limb 33. In this case, the limb 33 is cut away at the side, with the result that the wire wrap contact 32 has a bearing face, which is as large as possible, facing the limb 33. This allows for a good connection between the fork contact 31 and the wire wrap contact 32 by means of welding or adhesive bonding or similar joining processes with a form-fitting and force-fitting connection. As can therefore be seen, the wire wrap contact 32 is arranged asymmetrically with respect to the fork contact 31. The contact elements 30 are now arranged such that they are turned alternately in each case through 180° about the longitudinal axis L of the contact element 30. As a result, the wire wrap contacts 32 lie in two planes or in two rows one on top of the other. The stop edges 34 also lie such that they are turned correspondingly.

The first housing part 10 has two rows of openings 11, 12, the openings 11 of the upper row being offset with respect to the openings 12 of the lower row, namely by the distance between two fork contacts 31. The distance between two openings 11 or 12 in a row then has another, larger spacing and, for example, is as large as twice the spacing between the fork contacts 31 on the printed circuit board 40. As a result, the distance between the wire wrap contacts 32 of the same and different rows is increased such that sufficient space exists for a connection tool. On the upper side 13, the first housing part 10 has three latching openings 14, which correspond to three latching tabs 21 of the second housing part 20. The second housing part 20 has chambers 22, into which the fork contacts 31 are inserted. The chambers 22 are in this case preferably formed with webs (not shown), which are rounded off or beveled in the front region towards the printed circuit board 40 in order to make it easier for them to be plugged onto the printed circuit board 40. The contact regions 35 of the fork contacts 31 in this case protrude beyond the webs, with the result that contact with the printed circuit board 40 is ensured. As regards the precise configuration, reference can be made here to DE 102 57 308 B3 (in particular FIG. 2 and FIG. 3).

For assembly purposes, the contact elements 30 are pushed with their wire wrap contacts 32 into the first housing part 10 through the openings 11, 12, the contact elements 30 then hitting, with the edge 36, against the first housing part 10 on the inside. Subsequently, the second housing part 20 is then pushed on, the fork contacts 31 entering into the chamber 22, and the first and second housing parts 10, 20 finally latching with one another. In this case, the procedure can also be reversed, such that, first, the contact elements 30 are pushed into the second housing part 20. The second housing part 20 furthermore also has two further latching hooks 23, by means of which the plug-in connector 1 can be latched into a further housing, as is also described in DE 102 57 308 B3.

Figure 2:
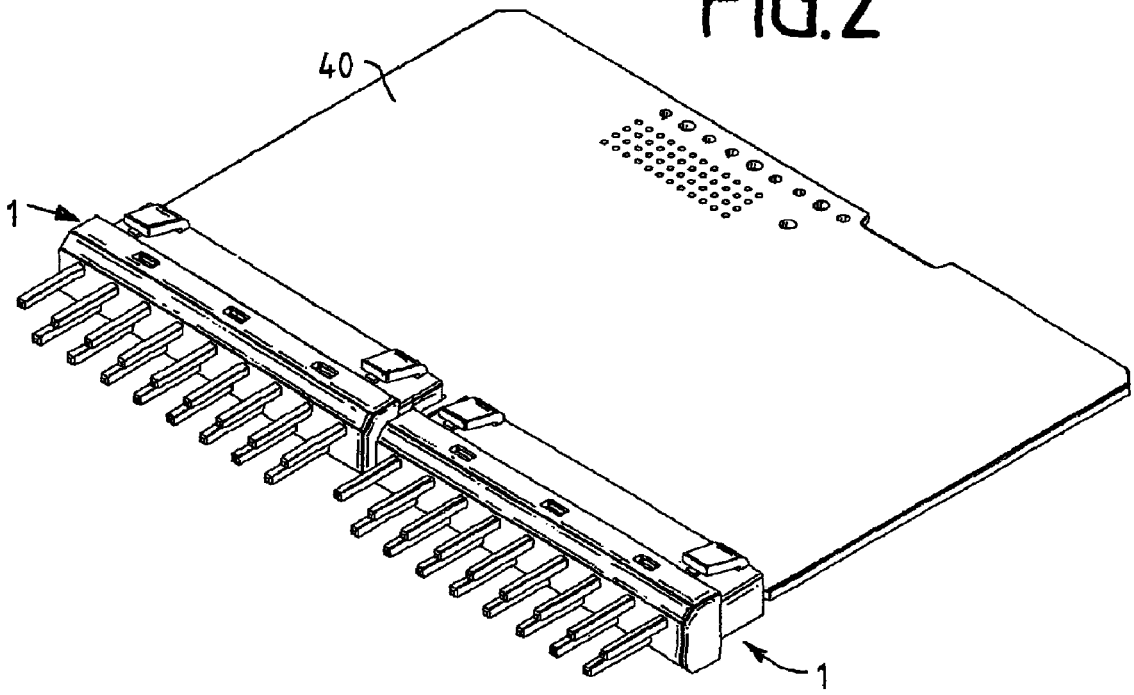
FIG. 2 shows a perspective illustration of a printed circuit board having two plug-in connectors.

Finally, FIG. 2 illustrates how two plug-in connectors 1, each having seventeen poles, are plugged onto a printed circuit board 40.

LIST OF REFERENCE SYMBOLS

1 Plug-in connector
10 First housing part
11, 12 Openings
13 Upper side
14 Latching openings
20 Second housing part
21 Latching tabs
22 Chambers
23 Latching hooks
30 Contact elements
31 Fork contact
32 Wire wrap contact
33 Limb
34 Stop edge
35 Contact regions
36 Edge
40 Printed circuit board

The invention claimed is:

1. A plug-in connector for printed circuit boards, comprising:

a number of contact elements, the contact elements each having two connection sides, one connection side defining a wire connection contact for connecting wires, and the other connection side defining a fork contact for making contact with connecting pads on a printed circuit board, each fork contact having a first side at which the wire connection contact connects and an opposite second side at which a stop edge is formed, and a plastic housing in which the contact elements are arranged so that the wire connection contacts are accessible from outside the housing, the housing including a first housing piece that is configured to latch to a second housing piece, wherein the wire connection contacts are in the form of wire wrap contacts, which are arranged in at least two rows, the wire wrap contacts of the different rows being arranged such that the wire wrap contacts are offset with respect to one another.

2. The plug-in connector as claimed in claim 1, wherein the contact elements each have an identical shape, the wire wrap contact of each contact element being aligned asymmetrically with respect to the fork contact, and the contact elements being arranged in the plug-in connector such that each of the contact elements are turned alternately through 180° about a longitudinal axis of the contact element.

3. The plug-in connector as claimed in claim 1, wherein the contact elements are arranged in the plastic housing such that the contact elements are secured against falling out.

4. The plug-in connector as claimed in claim 3, wherein the second sides of the fork contacts of the contact elements are each formed with a limb that extends laterally relative to the fork contact.

5. The plug-in connector as claimed in claim 4, wherein the limb of each fork contact defines the stop edge, which is supported in the housing.

6. The plug-in connector as claimed in claim 1, wherein the plastic housing comprises at least one region defining a chamber, and the fork contacts are completely accommodated in a longitudinal direction in the chamber defined by the plastic housing.

* * * * *